US006231943B1

(12) United States Patent
Nijboer et al.

(10) Patent No.: US 6,231,943 B1
(45) Date of Patent: May 15, 2001

(54) RECORD PAD

(75) Inventors: Anton Nijboer; Fokke Jager, both of Drachten; Henry Wowick Dingley, Nederhorst D Berg, all of (NL)

(73) Assignee: Moore Business Forms, Inc., Grand Island, NY (US)

( * ) Notice: Subject to any disclaimer, the term of this patent is extended or adjusted under 35 U.S.C. 154(b) by 570 days.

(21) Appl. No.: 08/590,278

(22) Filed: Jan. 23, 1996

(30) Foreign Application Priority Data

Jan. 27, 1995 (NL) ..... 9500155

(51) Int. Cl.[7] ..... B42D 5/00

(52) U.S. Cl. ..... 428/40.1; 281/17; 281/44; 428/41.7; 428/42.1; 428/42.2; 428/42.3; 428/43; 428/121; 428/192; 428/194; 462/7; 462/17; 462/20; 462/21; 462/72

(58) Field of Search ..... 428/40.1, 41.7, 428/42.1, 42.2, 42.3, 43, 192, 194, 121; 462/17, 7, 20, 21, 72; 281/17, 44

(56) References Cited

U.S. PATENT DOCUMENTS

| | | | |
|---|---|---|---|
| 3,945,870 | 3/1976 | Johnsen | 156/201 |
| 4,533,160 | 8/1985 | Malone | 283/81 |
| 4,590,109 | 5/1986 | Holmberg | 428/40.1 |
| 5,328,409 | 7/1994 | Marquardt | 462/17 |

FOREIGN PATENT DOCUMENTS

| | | |
|---|---|---|
| 2435049 | 2/1975 | (DE) . |
| 325057 | 7/1989 | (EP) . |
| 486127 | 5/1992 | (EP) . |

OTHER PUBLICATIONS

Drakes Office System Ltd. 1991 publicly used record book.

*Primary Examiner*—Nasser Ahmad
(74) *Attorney, Agent, or Firm*—Nixon & Vanderhye PC

(57) ABSTRACT

A record pad is provided having a paper top sheet with top and bottom faces and an underlying record bottom sheet with a transfer medium between them. The top sheet has an upper margin and a pattern (such as a substantially continuous strip) of repositional adhesive is provided on each top sheet bottom face adjacent the upper margin and substantially parallel to the upper margin. This provides a record pad construction which is more user friendly particularly for left handed writers, and makes it simpler to attach a top sheet—once removed from the pad—to another sheet or object. Preferably the top sheet is segmented into three different portions by through cut lines (or perforations or other lines of weakness), and along a securing edge of the top sheet another through cut line is provided, substantially perpendicular to the upper margin. The repositional adhesive strips are spaced from the upper margin or lines of weakness about 1—5 mm (e.g. about 2 mm).

6 Claims, 3 Drawing Sheets

RECORD PAD

BACKGROUND AND SUMMARY OF THE INVENTION

Known record pads, such as shown in European patent 325,057, have a top (copy) sheet and a record sheet underlying the copy sheet, with a transfer mechanism (such as carbonless coatings, or carbon paper) between them for transferring indicia placed on the top sheet onto the record sheet. A side margin is provided which secures the sheets to a ring binder or the like, with a perforation along the side edge to allow detachment of the top sheet. A strip of repositional adhesive is provided on the copy sheet at the edge adjacent and parallel to the securing margin, covering the securing edge margin as well. This known record pad is intended to be used with the securing edge margin at the left of the writer. Because of this both the securing edge margin and the strip of repositional adhesive are provided at the left side edge of the copy sheet.

In the prior art construction described above, because the copy sheet carries the strip of repositionable adhesive at its left side-edge, the copy sheet must be pressed on an object with its left side-edge to adhere the copy sheet to the object when a message is written on the copy sheet, and the copy sheet has been removed from the record pad. This is cumbersome for the user since the most commonly used products with repositional adhesive (such as the Moore Business Forms, Inc. "NOTE STIX®" product and 3M's "POST-IT®" products) carry a strip of adhesive at the upper edge of a rectangular sheet and therefore one presses the upper edge of the copy sheet against the object by habit. Of course such a procedure will not work utilizing detached copy sheets from European patent 325,057.

According to the present invention a record pad is provided that has a number of advantages compared to the prior art as exemplified by European 325,057. The record pad according to the present invention is more user friendly for left-handed writers, and provides the strip of repositional adhesive on the copy sheet adjacent the upper margin to make it easier to use in general. The record pad according to the invention also can have a mechanical attachment for securing lo the sheets at their securing edge which may be the upper edge margin so that there is no obstruction for left-handed writers, and when removing the copy sheet from the record pad the action for removing is simply in one direction, there being no necessity to detach any of the copy sheet elements along two different edges. Also according to the invention there is no necessity to provide a strip of adhesive between the securing edge margins such as shown in European 325,057, therefore making it much easier and simpler to remove top sheet portions, and requiring less adhesive to construct the record pad. Also with the construction of the invention it is simpler to secure multiple superimposed sheet sets to each other (with adhesive, staples, or conventional binder elements) without the risk of sliding sheet sets out of position during the securement action. In general the top sheet is attached to the second sheet of each set using repositional adhesive on the back of the top sheet, thus allowing the top sheet to be cut through rather than perforated.

According to one aspect of the present invention a record pad is provided which comprises the following components: A plurality of sheet sets, each sheet set comprising a paper top sheet having a top face and a bottom face, at least one underlying record bottom sheet, and a transfer mechanism for transferring indicia imaged on the top sheet to an underlying the record sheet. The top sheet comprises an upper margin, a lower margin substantially parallel to the upper margin, and first and second side margins substantially perpendicular to the upper and lower margins, the upper margin being at the upper portion of the top sheet during normal use of the top sheet to enter indicia on the top sheet. A securing edge margin of each sheet set of the plurality of sheet sets for connecting the sheet sets in a record pad. And, a pattern of repositional adhesive provided on each top sheet bottom face adjacent to the upper margin and substantially parallel to the upper margin.

The patterns of repositional adhesive are preferably substantially continuous linear strips of adhesive, and the repositional adhesive is of the type such as CLEANTAC® adhesive sold by Moore Business Forms, Inc. of Lake Forest, Ill., or the adhesive in conventional 3M POST-IT® notes, or an adhesive such as shown in Swiss patent 452,479. However other patterns, such as discontinuous strips, pluralities of dots or other shapes, or the like may be provided.

Typically the top sheet upper and lower margins are shorter than the top sheet side margins for the entire top sheet, however the individual portions which are separated by lines of weakness, such as perforations, or preferably, through cuts have a longer upper and lower margin than side margins. The securing edge margin of each sheet set may be adjacent the upper margin of each of the top sheets in the record pad to provide the advantages as set forth above, or there could be a conventional securing edge margin along the first side margin. A mechanical attachment is provided adjacent the securing edge margin connecting all of the sheet sets together, and a line of weakness between the top sheet and the mechanical attachment is preferably provided. The mechanical attachment may comprise a conventional ring binder, staples, clamps, or the like.

It is also advantageous to provide the strip or other pattern of repositional adhesive so that it is spaced from a line of weakness that it is adjacent to, to allow a cleaner and more effective detachment of a top sheet portion from the record pad. For this reason the patterns of lo repositional adhesive are preferably spaced from the upper margin or lines of weakness or cut through about 1–5 mm, preferably about 2 mm. Also, as is conventional, it is desirable to provide a foldable flap with the record pad, which may placed underneath the record sheet of the sheet set being utilized at one particular time to act as a writing shield so that indicia is not transferred, undesirably, to lower record sheets.

According to another aspect of the present invention a record pad is provided comprising the following elements: A plurality of sheet sets, each sheet set comprising a paper top sheet having a top face and a bottom face, at least one underlying record bottom sheet. The top sheet being quadrate and comprising an upper margin, a lower margin substantially parallel to the upper margin, and first and second side margins substantially perpendicular to the upper and lower margins, the upper margin being at the upper portion of the top sheet during normal use of the top sheet to enter indicia on the top sheet. A securing edge margin of each sheet set of the plurality of sheet sets for connecting the sheet sets in a record pad. At least one line of weakness in each the top sheet extending substantially parallel to the upper margin dividing the top sheet into at least a first portion containing the upper margin, and at least a second portion on the opposite side of the at least one line of weakness from the upper margin. And, a first pattern of repositional adhesive provided on each the top sheet bottom face adjacent to the upper margin and substantially parallel to the upper margin and at least a second pattern of repositional adhesive on the bottom face of the top sheet adjacent a through cut on the opposite side thereof from the upper margin, the second pattern substantially parallel to the upper margin. The details of the record pad may be as described above. Also the edge margin need not necessarily be secured by the top sheet, but can be secured only by the bottom sheet.

It is the primary object of the present invention to provide an effective, user friendly, record pad with a conveniently located repositional adhesive pattern. This and other objects of the invention will become clear from an inspection of the detailed description of the invention, and from the appended claims.

DETAILED DESCRIPTION OF THE DRAWINGS

Figure 1:
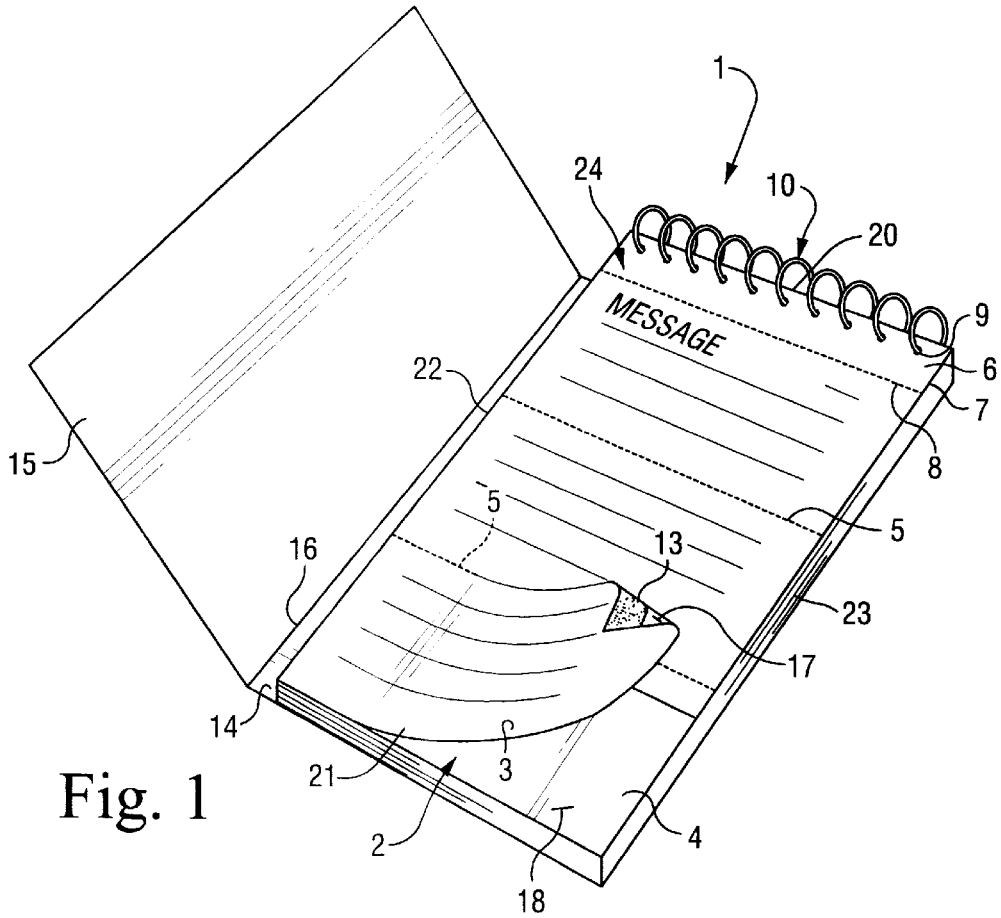
FIG. 1 is a top perspective view of a first embodiment of a record pad according to the present invention, showing one of the top sheet portions being torn off from the pad, exposing the bottom sheet thereunder.
Figure 2:
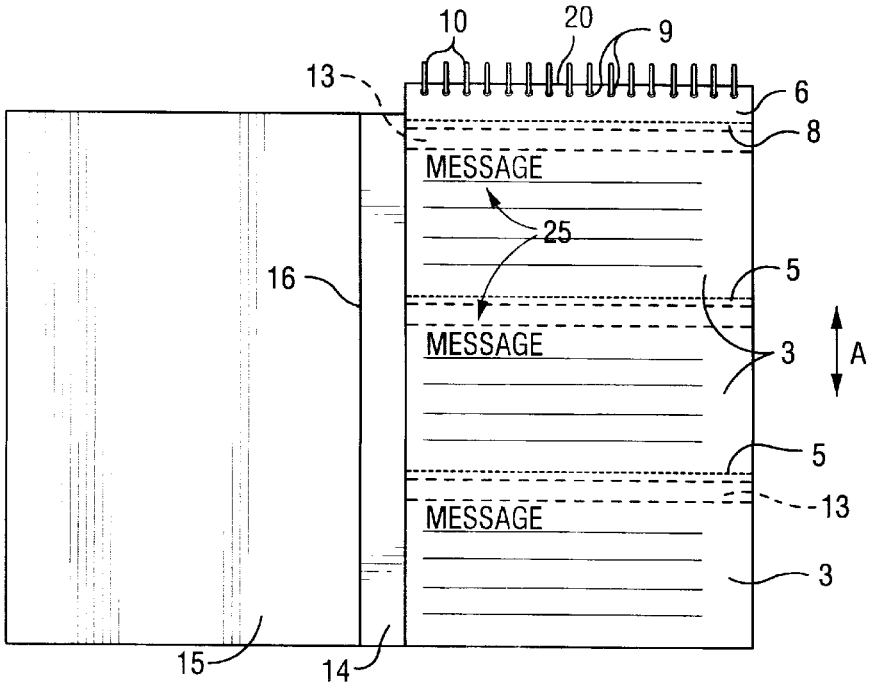
FIG. 2 is a top plan view of the pad of FIG. 1.
Figure 3:
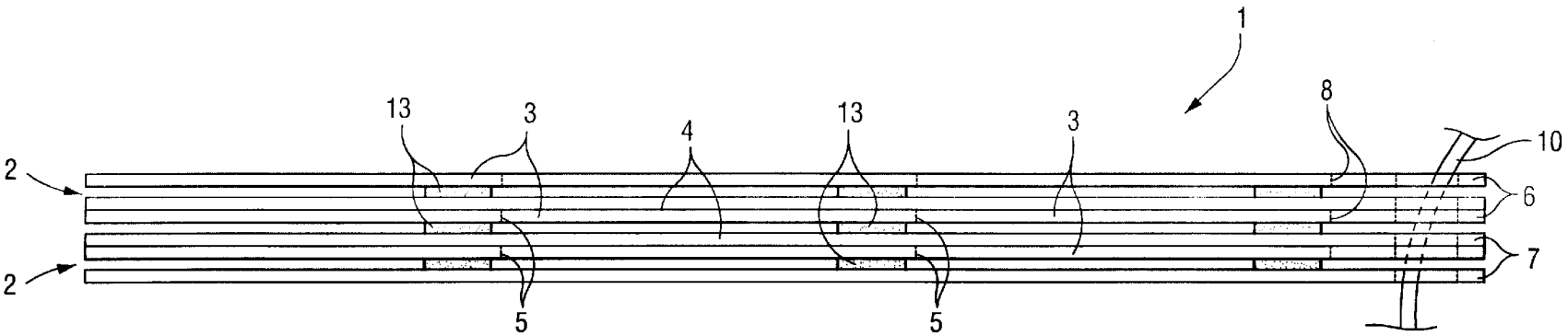
FIG. 3 is a side view of the pad of FIG. 1 and 2.

An exemplary record pad according to the present invention is shown generally by reference numeral 1 in FIGS. 1–3. A plurality of sheet sets 2 are arranged in close juxtaposition to each other. Each set 2 includes a paper top sheet 3 having a top face and a bottom face, the top face primarily being seen in FIG. 1 but the bottom face being visible at one corner of the bottom third of the top sheet 3 in FIG. 1. Each set 2 also includes at least one underlying record bottom sheet 4 with a transfer mechanism provided for transferring indicia imaged on the top sheet 3 top face to an underlying record sheet 4. The transfer means may comprise any suitable mechanism such as a CB top sheet 3 and CF bottom sheet 4, or a self-contained self-imaging carbonless coating on the record sheet 4, or a sheet of carbon paper (not shown). Carbonless coatings are preferred.

Preferably the top sheet 3 has an upper margin 20, or the perforation line 8, or for lower portions of the top sheet 3 the lines of weakness (perforation, or cut through) lines 5. A securing edge margin is provided for each sheet set 2. In the embodiment illustrated in FIG. 1 a securing margin 6, 7 may be provided for each of the top sheet 3 and the record sheet 4, respectively, which may include openings 9 for attachment to a conventional ring binder element 10 (or other conventional mechanical attachment such as staples, clamps, clips, or the like). However because repositional adhesive strips are utilized as will be described below, it is not always essential to provide the securing edge margin 6, rather only the edge margin 7 need necessarily be provided, although both margins 6, 7 are preferred.

A pattern of repositional adhesive is provided on each top sheet 3 bottom face adjacent the upper margin 20 and substantially parallel to the upper margin 20. The upper margin 20 is parallel to the lower margin 21, and they are both transverse to first and second side margins 22, 23. A plurality of patterns of repositional adhesive are shown generally by reference numeral 13 in FIGS. 1 through 3, at least one such pattern adjacent the upper margin 20 being provided, but for the embodiment actually illustrated in the drawings where the through cut lines 5 are provided in addition to the perforation line 8, three different patterns 13 are provided, one adjacent the perforation line 8 and the others adjacent the through cut lines 5. As seen most clearly in both FIGS. 1 and 2, while the patterns 13 are adjacent the cut through lines 5, 8 they are preferably slightly spaced therefrom, e.g. about 1–5 mm, preferably about 2 mm.

As seen in FIGS. 1 through 3 preferably for the entire top sheet 3 the side edges 22, 23 are significantly longer than the upper and lower margins 20, 21, but for each of the three different portions that are separable from the top sheet 3 as illustrated in the drawings the edges parallel to the upper margin 20 are longer than the side edges, providing a rectangular configuration.

Figure 4:
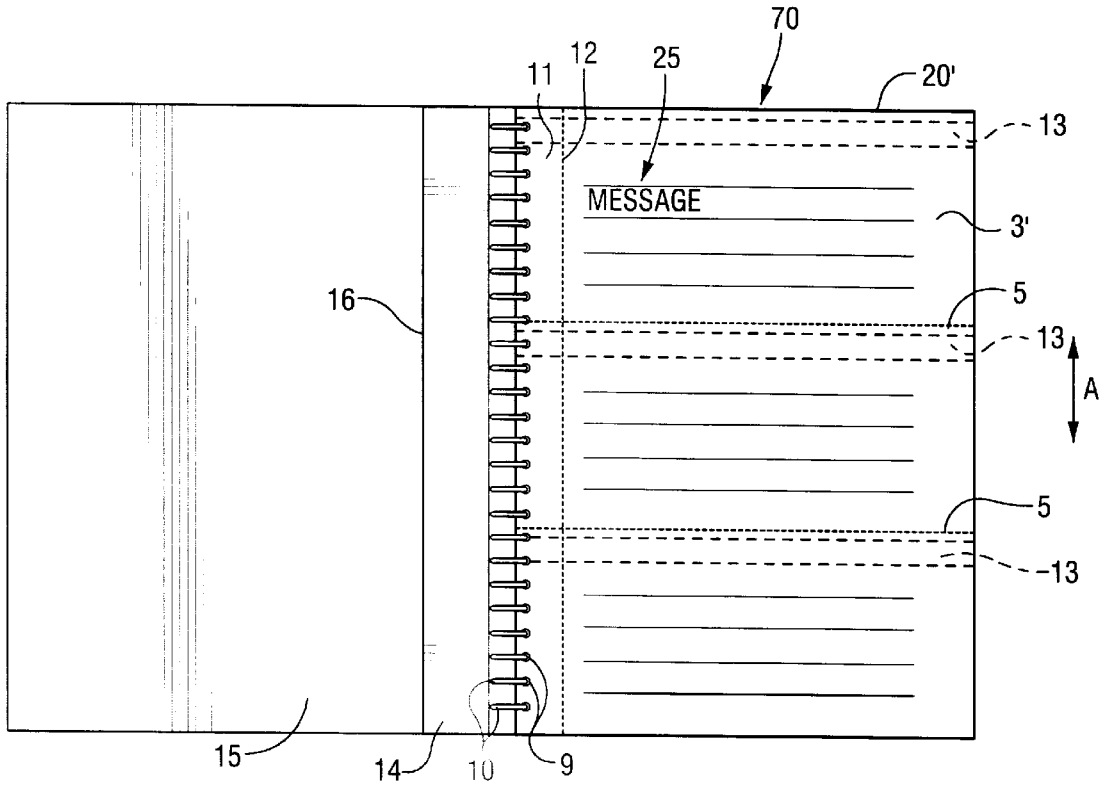
FIG. 4 is a top plan view of a second embodiment of a record pad according to the present invention.

The embodiment of FIG. 4 shows a record pad 1' that is similar to that of FIGS. 1 through 3 except that the securing edge margin 11 is at the left side of the record sheet (not seen in FIG. 4 but comparable to sheet 4 in FIG. 1) and preferably the sheet 3' too. A line of perforation 12 perpendicular to the adhesive patterns 13 is provided in the securing edge margin 11 of the top sheet 3', and each of the adhesive patterns 13 (which may comprise substantially continuous repositional adhesive strips, or discontinuous strips, or other patterns such as series of dots or other shapes) is spaced a small distance (e.g. between about 1–5 mm typically about 2 mm) from either the upper margin 20', or the lines of weakness 5, as seen in FIG. 4, the adhesive strips 13 being provided on the back of the top sheet 3' as in the FIGS. 1 through 3 embodiments.

For both embodiments it is preferred that there be indicia printed or otherwise imaged on the top sheet 3 when the record pad 1 is sold. This indicia—for example schematically illustrated by the word "Message" in FIGS. 1, 2, and 4—is to facilitate utilization of the top sheet 3, or portions of the top sheet 3, as message notes or business forms. The orientation of the letters of the indicia 25—as seen in FIGS. 1, 2, and 4—is such that the margin 20, 20' is the upper margin during use.

In the preferred embodiment a foldable flap 15 is also preferably provided, for example providing the front cover of the record pad 1, 1' with a sheet of cardboard 14 connected to the mechanical attachment 10, and the flap 15 foldable about an axis parallel to the side edges (e.g. 22, 23) of the top sheet 3, 3' e.g. foldable about fold line 16. The flap can be inserted between the uppermost sheet set 2 of the record pad 1 and the next succeeding sheet set 2 in order to prevent indicia imprinted on the uppermost top sheet 3 from transferring (through the transfer mechanism, such as carbon paper or carbonless coatings) to underlying record sheets 4 in the pad 1. That is the foldable flap 15 acts as a writing shield.

The transfer mechanism may comprise a CB coating 17 (see FIG. 1) on the top sheet 3 and a CF coating 18 (see FIG. 1) on record sheet 4; or a self-contained, self-imaging carbonless coating may be provided on the record sheet 4; or carbon paper (not shown) or the like may be utilized, as well as any other conventional alternatives for transferring indicia imprinted on the top sheet 3 to its associated record sheet 4 (or record sheets, if a plurality of record sheets are associated with a single top sheet 3).

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A record pad comprising:

a plurality of sheet sets, each sheet set comprising a paper top sheet having a top face and a bottom face, at least one underlying record bottom sheet, and a transfer mechanism for transferring indicia imaged on said top sheet to an underlying said record sheet;

said top sheet comprising an upper margin, a lower margin substantially parallel to said upper margin, and first and second side margins substantially perpendicular to said upper and lower margins, said upper margin being at the upper portion of said top sheet during normal use of said top sheet to enter indicia on said top sheet;

a securing edge margin of each sheet set of said plurality of sheet sets for connecting said sheet sets in a record pad;

a pattern of repositional adhesive provided on each said top sheet bottom face adjacent to said upper margin and substantially parallel to said upper margin; and wherein said securing edge margin of each sheet set is at said first side margin of each of said top sheets and said record sheets.

2. A record pad comprising:

a plurality of sheet sets, each sheet said comprising a paper top sheet having a top face and a bottom face, at least one underlying record bottom sheet;

said top sheet being quadrate and comprising an upper margin, a lower margin substantially parallel to said upper margin , and first and second side margins substantially perpendicular to said upper and lower margins, said upper margin being at the upper portion of said top sheet during normal use of said top sheet to enter indicia on said top sheet;

a securing edge margin of each sheet set of said plurality of sheet sets for connecting said sheet sets in a record pad;

at least one line of weakness in each said top sheet extending substantially parallel to said upper margin dividing said top sheet into at least a first portion containing said upper margin, and at least a second portion on the opposite side of said at least one line of weakness from said upper margin;

a first pattern of repositional adhesive provided on each said top sheet bottom face adjacent to said upper margin and substantially parallel to said upper margin and at least a second pattern of repositional adhesive on said bottom face of top sheet adjacent a said line of weakness on the opposite side thereof from said upper margin, said second pattern substantially parallel to said upper margin; and wherein two lines are provided in said top sheets substantially parallel to said upper margin dividing said top sheet into three portions.

3. A record pad as recited in claim 2 further comprising a mechanical attachment adjacent said securing edge margin connecting all of said sheet sets together, and a through cut line between said top sheet and said mechanical attachment; and wherein said lines of weakness are through cut lines.

4. A record pad comprising:

a plurality of sheet sets, each sheet set comprising a paper top sheet having a top face and a bottom face, at least one underlying record bottom sheet, and a transfer mechanism for transferring indicia imaged on said top sheet to an underlying said record sheet;

said top sheet comprising an upper margin, a lower margin substantially parallel to said upper margin, and first and second side margins substantially perpendicular to said upper and lower margins, said upper margin being at the upper portion of said top sheet during normal use of said top sheet to enter indicia on said top sheet;

a securing edge margin of each sheet set of said plurality of sheet sets for connecting said sheet sets in a record pad;

a pattern of repositional adhesive provided on each said top sheet bottom face adjacent to said upper margin and substantially parallel to said upper margin; and a foldable flap connected along a said side edge of said sheet sets and foldable about a fold line parallel to said side edges.

5. A record pad comprising:

a plurality of sheet sets, each sheet set comprising a paper top sheet having a top face and a bottom face, at least one underlying record bottom sheet, and a transfer mechanism for transferring indicia imaged on said top sheet to an underlying said record sheet;

said top sheet comprising an upper margin, a lower margin substantially parallel to said upper margin, and first and second side margins substantially perpendicular to said upper and lower margins, said upper margin being at the upper portion of said top sheet during normal use of said top sheet to enter indicia on said top sheet;

a securing edge margin of each sheet set of said plurality of sheet sets for connecting said sheet sets in a record pad;

a pattern of repositional adhesive provided on each said top sheet bottom face adjacent to said upper margin and substantially parallel to said upper margin;

at least one line of weakness in each said top sheet extending substantially parallel to said upper margin dividing said top sheet into at least a first portion containing said upper margin, and at least a second portion on the opposite side of said at least one line of weakness from said upper margin; and wherein said pattern of repositional adhesive comprises a first pattern;

at least a second pattern of repositional adhesive on said bottom face of top sheet adjacent a said line of weakness on the opposite side thereof from said upper margin, said second pattern substantially parallel to said upper margin; and wherein two lines of weakness are provided in said top sheets substantially parallel to said upper margin dividing said top sheet into three portions.

6. A record pad as recited in claim 5 wherein said pattern of repositional adhesive is a substantially continuous linear strip of adhesive, and wherein said lines of weakness are through cut lines.

* * * * *